US005564388A

United States Patent [19]

Meiwes et al.

[11] Patent Number: 5,564,388

[45] Date of Patent: Oct. 15, 1996

[54] DEVICE FOR CONTROLLING THE IDLING SPEED OF AN INTERNAL COMBUSTION ENGINE

[75] Inventors: Johannes Meiwes, Markgroeningen; Albert Gerhard, Tamm; Uwe Hammer, Schwieberdingen, all of Germany

[73] Assignee: Robert Bosch GmbH, Stuttgart, Germany

[21] Appl. No.: 483,417

[22] Filed: Jun. 7, 1995

[30] Foreign Application Priority Data

Sep. 6, 1994 [DE] Germany ..... 44 31 712.3

[51] Int. Cl.[6] ..... F02D 41/06; F02D 9/02; F01L 7/00

[52] U.S. Cl. ..... 123/339.25; 123/339.27; 123/585

[58] Field of Search ..... 123/339.14, 339.23, 123/339.25, 585, 339.27; 251/129.11, 129.15

[56] References Cited

U.S. PATENT DOCUMENTS 4,962,737 10/1990 Brand et al. ..... 123/339.25 X
5,381,768 1/1995 Togai et al. ..... 123/585 X

OTHER PUBLICATIONS

SAE Paper No. 920294, "Development of Air–Assisted Injector System", Harada et al.

*Primary Examiner*—Tony M. Argenbright
*Attorney, Agent, or Firm*—Edwin E. Greigg; Ronald E. Greigg

[57] ABSTRACT

A device for controlling the idling speed of an internal combustion engine by controlling a quantity of operating medium which can be fed to the internal combustion engine from an operating medium source via at least two flow lines. A first valve operating area is controlled at a first valve opening by a first valve closing element, and a second valve opening area is controlled at a second valve opening by a second valve closing element. The first and the second valve closing elements can be adjusted by an actuator in such a way that the first valve opening and the second valve opening are arranged in series one behind the other between the operating medium source and the intake port of the internal combustion engine. The valve closing elements are coupled to one another in such a way that when they are actuated the first valve closing element always firstly clears a flow area at the first valve opening (34) and only then does the second valve closing element clear a flow area at the second valve opening (36).

10 Claims, 4 Drawing Sheets

DEVICE FOR CONTROLLING THE IDLING SPEED OF AN INTERNAL COMBUSTION ENGINE

PRIOR ART

The invention is based on a device for controlling the idling speed of an internal combustion engine as defined hereinafter. Such a device is already known (development of air-assisted injector system, SAE (Society of Automotive Engineers), Technical Paper Series 920294, pages 57/58, 1992) in which a first valve closing element controls a first valve opening area which opens into a first flow line and a second valve closing element controls a second valve opening area which opens into a second flow line. The first flow line is connected to a fuel metering device of the internal combustion engine and serves to feed an operating medium, in particular intake air, to the fuel metering device for the purpose of air-supported fuel injection. The second flow line is directly connected to an intake port of the internal combustion engine downstream of a throttle valve which is arranged in the intake port. Via the second flow line, operating medium can be fed to the intake port and from there also to the internal combustion engine. The first and second valve closing elements can be adjusted in the valve opening direction by means of an electromotive actuator via an adjustment element counter to the force of the valve closing spring, the valve closing elements being held in a valve closing position by the valve closing spring when the actuator is not activated. The known device has the disadvantage that the operating medium source is continuously connected to the valve devices which comprise the second valve closing element so that the operating medium, in particular intake air, can pass in an uncontrolled way as a leakage flow past the second valve closing element to the intake port of the internal combustion engine.

ADVANTAGES OF THE INVENTION

In contrast, the device according to the invention for controlling the idling speed of an internal combustion engine has the advantage that by virtue of the series connection of the valve devices for the enveloping air on the one hand and the idling air on the other such that the valve devices for the enveloping air are arranged upstream of the valve devices for the idling air, it is possible to reliably prevent a leakage flow into the intake port of the internal combustion engine until the valve devices for the enveloping air are opened since it is only then that the operating medium is available on the inlet side of the downstream valve devices for the idling air.

By means of the measures specified herein, advantageous developments and improvements of the device according to the invention are possible.

BRIEF DESCRIPTION OF THE DRAWINGS

The invention is explained in greater detail below with reference to the drawings, in which.

DESCRIPTION OF EXEMPLARY EMBODIMENTS

Before details are given below of the different exemplary embodiments of the invention, the principle on which the device according to the invention is based will be initially explained in greater detail with reference to the diagrammatic view according to FIG. 1.

Figure 1:
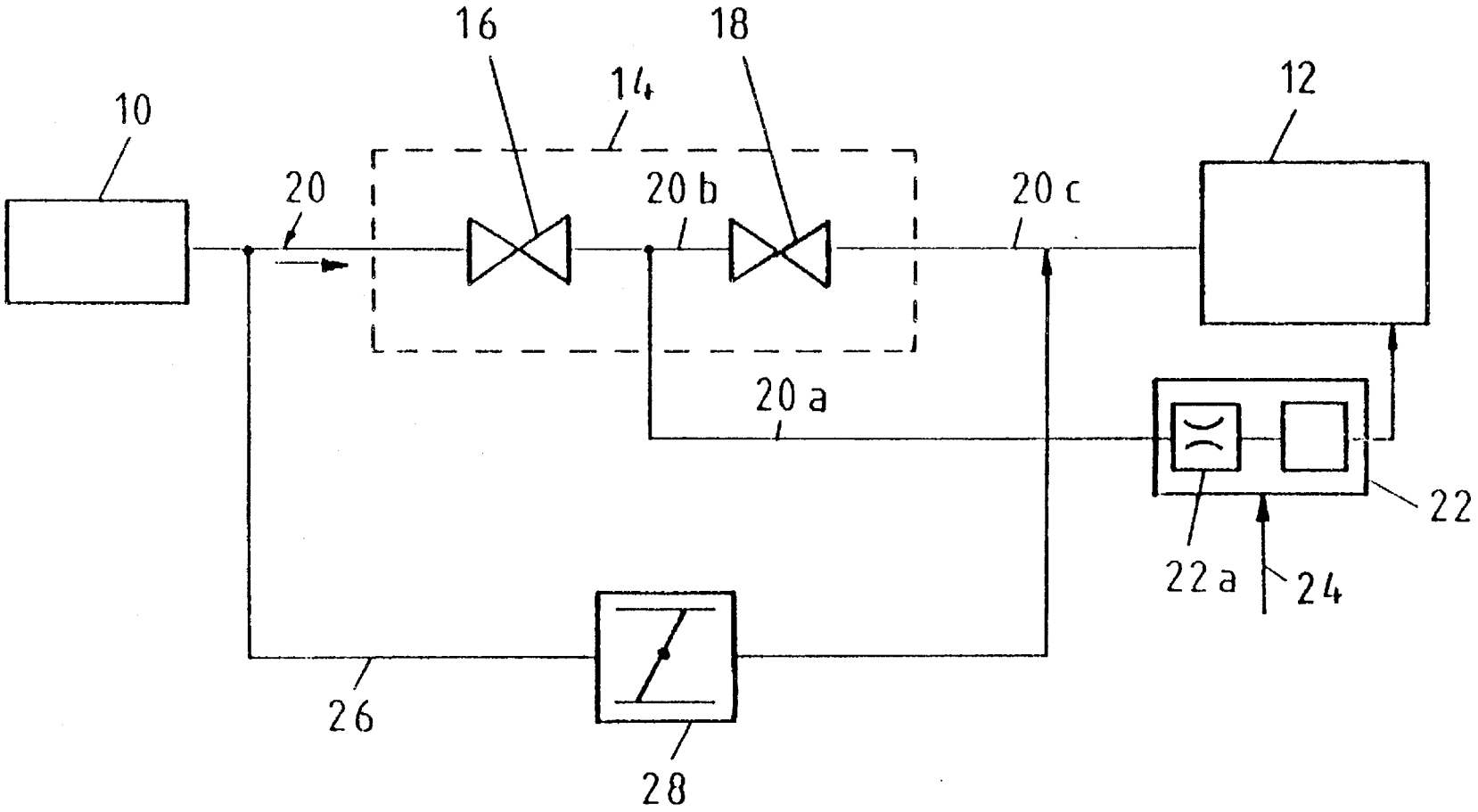
FIG. 1 shows a diagrammatic view of the arrangement of the valve device of a device according to the invention.

In particular, FIG. 1 shows a valve arrangement 14 located between an operating medium source 10 and an internal combustion engine 12 and having a first valve 16 and a second valve 18, these two valves 16, 18 being inserted in series one behind the other in a flow path 20 between the operating medium source 10 and the internal combustion engine 12. The flow path 20, in which the operating medium flows with the direction of flow indicated by an arrow, forks downstream of the first valve 16 into a first branch, which forms a first flow line **20*a*, and a second branch 20*b*. The first branch or the first flow line 20*a* leads to a fuel metering device 22, in particular a set of injection nozzles. The fuel metering device 22 is fed fuel, for example by a controlled fuel pump (not shown), via a fuel line 24 in a manner which is known and will not be explained in greater detail here. The quantity of operating medium, intake air or combustion air or a mixture of fresh air and fed-back exhaust gases, the said quantity being fed from the outlet side of the first valve 16 via the first flow line, serves for the so-called "air enveloping" for the injection nozzle(s) of the fuel metering device 22, the throttling effect of the injection nozzle(s) in FIG. 1 being indicated by a throttle point 22*a* in the fuel metering device 22. The enveloping air which is mixed with the fuel in the fuel metering device 22 is finally fed to the internal combustion engine 12**, for example into the individual intake manifolds of the cylinders directly upstream of the inlet valves.

The second branch **20*b* of the flow path 20 leads to the second valve 18, from whose outlet side a second flow line 20*c* leads to the internal combustion engine 12. In addition, a parallel path 26 into which a throttle valve 28 is inserted in a customary way is provided between the operating medium source 10 and the internal combustion engine 12**, parallel to the arrangement described above.

If the throttle valve 28 assumes, as indicated in FIG. 1, its closed position, or is virtually closed, the operating medium of the combustion air is fed to the internal combustion engine 12 via the valve arrangement 14 in the following way:

During the actuation of the valve arrangement 14 using an associated, for example electromechanical actuator (not shown), the first valve 16 opens first so that the fuel metering device 22 is fed enveloping air which ensures an effective preparation of the mixture with respect to the fuel fed to the fuel metering device 22 via the fuel line 24. The second valve 18 does not open, until the valve 16 is sufficiently opened so that the desired quantity of operating medium or combustion air is fed via the first flow line **20*a* to the fuel metering device 22. In order to feed air to the internal combustion engine 12, via the second flow line 20*c* in a customary way, the quantity of operating medium or combustion air required in addition to the enveloping air is fed by opening the second valve 18 in order to maintain the idling speed of the internal combustion engine. During this process it is to be ensured that the throttling effect, indicated by the throttle point 22*a*, of the elements of the fuel metering device 22 is constant and larger than the throttling effect of the second valve 18** in the fully opened state of the said valve.

Figure 2:
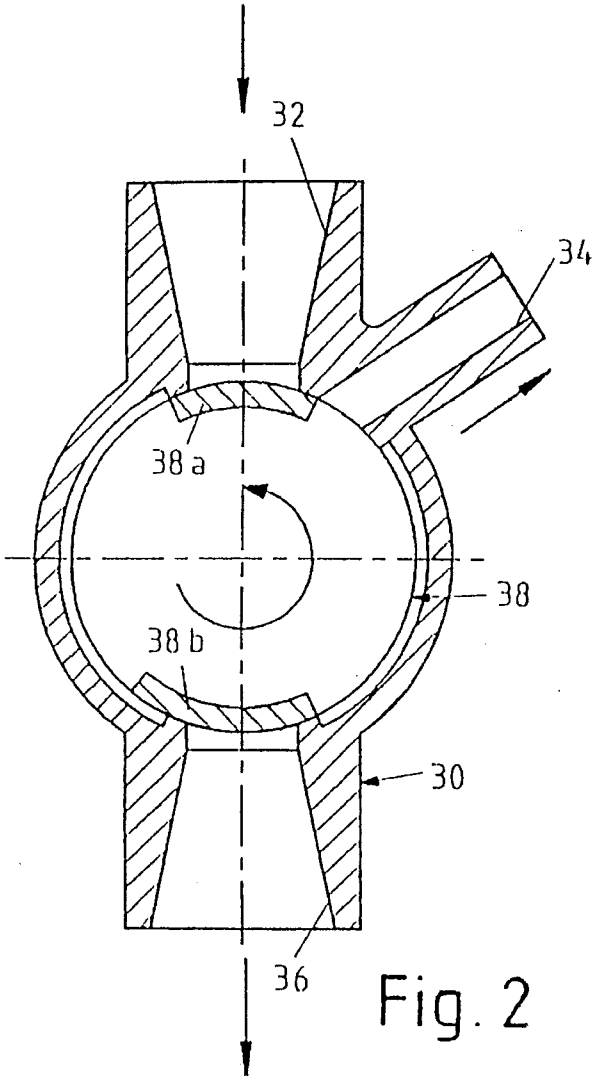

As FIG. 2 shows, the valve arrangement 14 explained above with reference to FIG. 1 can be realized according to a first preferred exemplary embodiment of the invention as a rotary valve arrangement or rotary actuator. This rotary actuator comprises, according to FIG. 2, a housing 30 with inlet 32, a first outlet 34 and a second outlet 36. The housing 30 defines a cylindrical chamber in which a rotatable component 38 is arranged which can be driven to rotate in the anticlockwise direction by an associated electromechanical actuator (not shown), as indicated by an arrow.

The rotatable component 38 bears two valve closing elements 38*a* and 38*b* which are formed on integrally or permanently attached in some other suitable way, each of which valve closing element 38*a* and 38*b* interacts with an associated valve seat on the inlet or on the second outlet 36. Here, the valve closing elements 38*a* and 38*b* can be seen as parts of a cylindrical skirt of the rotatable component 38, which skirt extends in the axial direction, i.e. perpendicularly with respect to the drawing plane in FIG. 2, at least over the complete height of the housing openings at the inlet 32 or at the outlet 36.

If the rotatable component 38 is rotated in an anticlockwise direction, starting from the closed position shown in FIG. 2 in which the inlet 32 is closed by the valve closing element 38*a* and the second outlet 36 is closed by the valve closing element 38*b*, an increasingly large flow area is cleared initially at the inlet 32 so that the operating medium or the combustion air from the operating medium source 10 can enter the interior of the housing 30 via the inlet 32 and can leave the said housing 30 via the first outlet 34 to the first flow line 20*a*. The second valve closing element 38*b* which extends over a larger arc length than the first valve closing element 38*a* does not begin to clear an increasingly large flow area at the second outlet 36, or for the second flow line 20*c*, until a prescribed flow area has been cleared by the valve closing element 38*a* at the inlet 32 of the housing 30. Correspondingly, when the rotatable component 38 is turned back, in the clockwise direction, the second outlet 36 is initially closed, and then the inlet 32. In this way it is ensured that during idling, i.e. when the throttle valve 28 is closed (FIG. 1), an adequate supply of enveloping air is at least initially ensured under all operating conditions via the first flow line 20*a* and the customary supply of idling air to the intake port of the internal combustion engine 12 is ensured only after that. Here, the rotary actuator shown in FIG. 2 is a very simple and robust design and permits a leakage flow of operating medium or of the air supply to be at least largely suppressed. A further important advantage of the rotary actuator according to FIG. 2 consists in the fact that the electromechanical actuator can be constructed in such a way that a prescribed electromechanical excitation of the drive is required for adjusting the closed position (shown in FIG. 2) for the rotatable component 38. If, according to this condition, the rotatable component 38 is kept under prestress in the anticlockwise direction using suitable spring means or the like, in this case failure of the electromagnetic excitation then leads to the rotatable component 38 being able to be rotated so far in the anticlockwise direction that the valve closing element 38*a*, 38*b* completely open the inlet 32 of the second outlet 36 so that a quantity of operating medium or air which is necessary for maintaining idling mode can in any case be fed to the internal combustion engine 12 when the throttle valve 28 is blocked.

Figure 3:
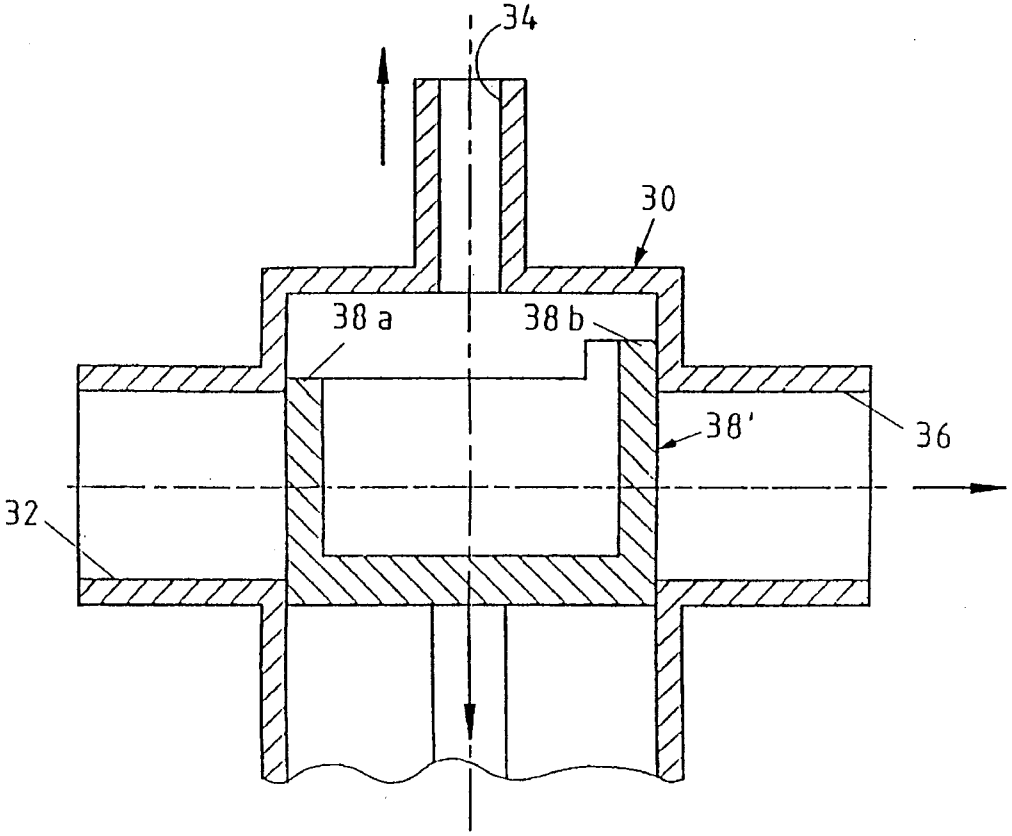
FIGS. 2, 3, 4 and 5, show different preferred embodiments of a device according to the invention.

According to FIG. 3 of the drawing, the valve arrangement 14 outlined in FIG. 1 can be realized in a further exemplary embodiment of the invention by a so-called lifting actuator in which, instead of the rotatable component 38 in FIG. 2, an axially adjustable, piston-shaped component 38' is provided in a housing 30 which has in turn an inlet 32, a first outlet 34 and a second outlet 36. If the component 38' is moved downwards, as indicated by an arrow, starting from the closed position shown in FIG. 3 using the associated electromechanical actuator (not shown), an increasingly large flow area is then initially cleared by a part 38*a*, which is lower in the axial direction of the piston skirt between the inlet 32 and the first outlet 34. Not until the component 38*b* has moved downwards by a prescribed distance does the upper edge of the higher skirt part 38*b* at the second outlet 36 also move into the area of the outlet opening, after which an increasingly large flow area is then also cleared at the second outlet 36. In this case also it is ensured that when the actuator is activated the fuel metering device 22 is initially enveloped with air and that the combustion air is not fed to the intake port of the internal combustion engine 12 until then. The valve arrangement according to FIG. 3 is also of comparatively simple and robust design and prevents undesired leakage flow to the internal combustion engine. If, in addition, the valve arrangement according to FIG. 3 is configured in such a way that the closed position shown in this figure is only reached by means of the component 38' when a corresponding exciter current is fed to the electromechanical actuator and if, in addition, the component 38' is under a corresponding prestress, directed downwards in FIG. 3, then also with this configuration it is ensured that the valve arrangement opens if the actuator fails and thus that an adequate quantity of air is fed to the internal combustion engine 12 to maintain the idling mode of the said internal combustion engine 12 if the actuator fails.

Figure 4:
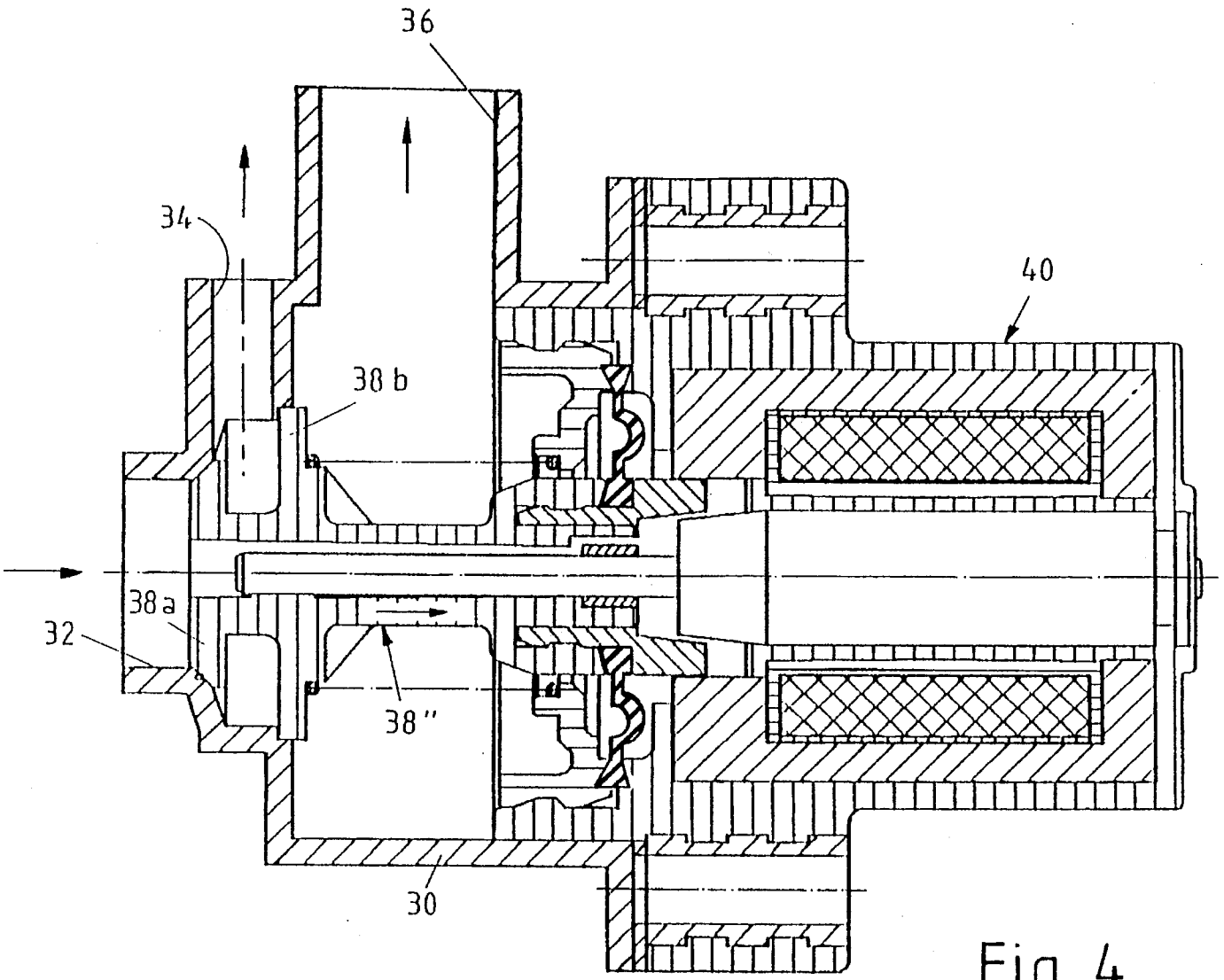

In the exemplary embodiment according to FIG. 4, the valve arrangement outlined in FIG. 1 is realized with two valves, connected in series, in such a way that two concentric housing openings are provided in a housing with an inlet 32, a first outlet 34 and a second outlet 36, with which housing openings two disk-shaped valve closing elements 38*a*, 38*b* interact and are mechanically connected to one another to form an axially movable component 38", the said valve closing elements 38*a*, 38*b* being capable of being adjusted together in the axial direction using an associated, in particular electromechanical actuator 40.

If in the device according to FIG. 4 a movement of the axially movable component 38" takes place in the direction of the indicated arrow, i.e. to the right in FIG. 4, using the electromagnetic actuator 40, then the valve closing element 38*a* is initially lifted off with its conical end face from the conical valve seat at the inlet 32 so that a fluid connection is made to the first outlet 34 and thus to the first flow line 20*a*. Here, the second valve closing element 38*b* still lies with its cylindrical outer face in a cylindrical collar in the region of the second housing opening. By virtue of the combination of the cylindrical collar and the cylindrical outer face, to a certain extent a degree of dead travel is therefore produced for the axial movement of the second valve closing element 38*b* which does not clear the associated second housing opening until a prescribed flow cross section is cleared by the first valve closing element 38*a*. When the second valve closing element 38*b* is opened during the course of a further axial movement of the axially movable component 38", a second flow path to the second outlet 36 is then cleared for the operating medium, via which flow path idling air can be fed to the internal combustion engine.

Figure 5:
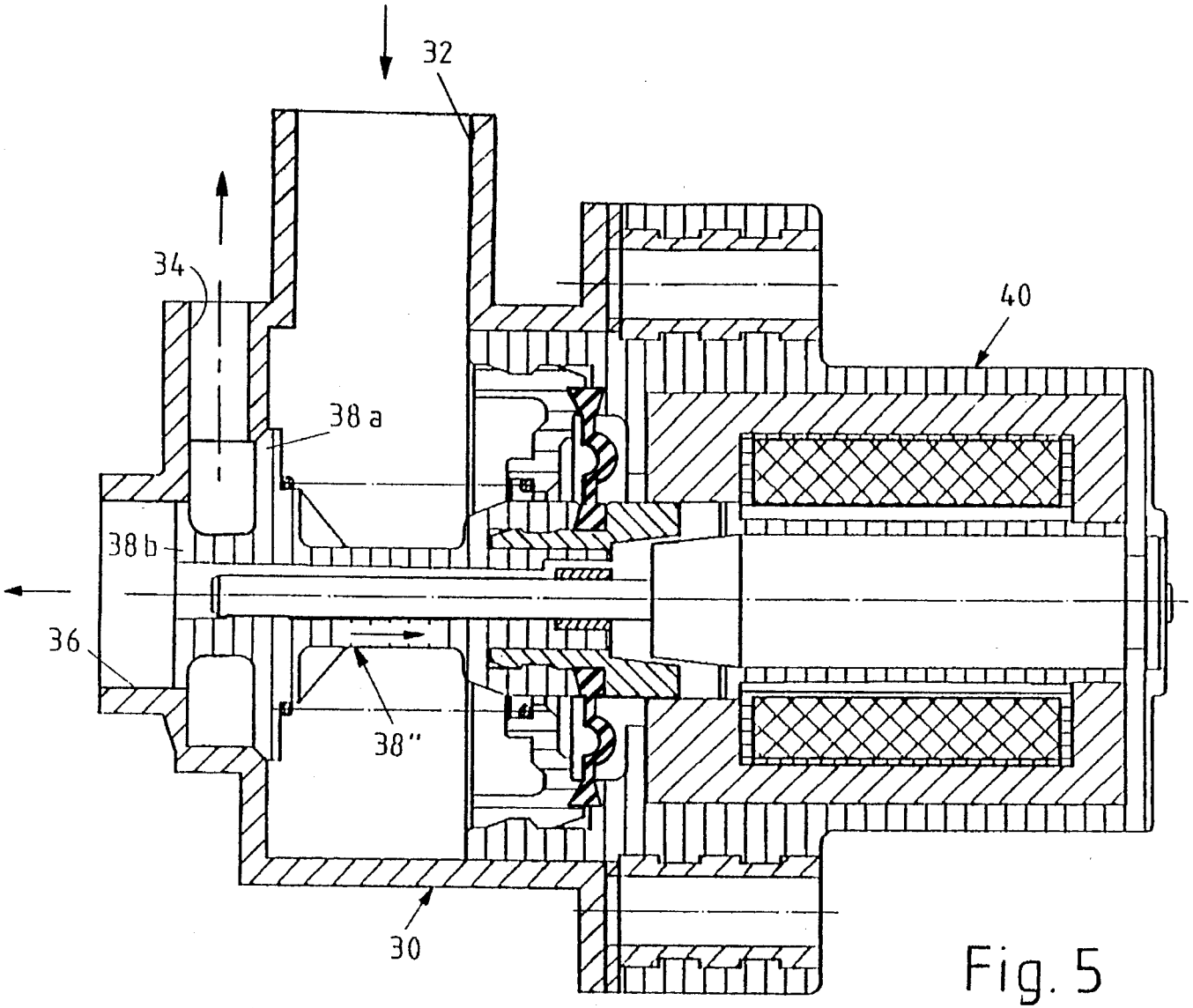

The device shown in FIG. 5 of the drawing according to a further preferred exemplary embodiment of the invention operates in principle like the device according to FIG. 4 but with the inlet 32 and the second outlet 36 interchanged with respect to the exemplary embodiment according to FIG. 4 so that in this case the first valve closing element 38*a* lies further in the interior of the housing 30 than the second valve closing element 38*b* whereas the situation is exactly the reverse in the exemplary embodiment according to FIG. 4.

Moreover, with regard to their conical end face or their cylindrical outer face, the valve closing elements 38*a* and 38*b* are of the same design as in FIG. 4 and act as described in FIG. 4.

The foregoing relates to preferred exemplary embodiments of the invention, it being understood that other variants and embodiments thereof are possible within the spirit and scope of the invention, the latter being defined by the appended claims.

We claim:

1. A device for controlling the idling speed of an internal combustion engine by controlling a quantity of operating medium which is fed to the internal combustion engine from an operating medium source via at least a first valve and a first flow line (20*a*) and via at least a second valve and a second flow line (20*c*), said first valve comprising a first valve closing element and said second valve comprising a second valve closing element, the first flow line leading to a fuel metering device and the second flow line leading to an intake port of the internal combustion engine downstream of a throttle valve (28) arranged in the intake port, and the first and the second valve closing elements are capable of being adjusted by means of an actuator, wherein the first valve (16) and the second valve (18) are arranged in series one behind the other between the operating medium source (10) and the intake port of the internal combustion engine (12), and wherein the valve closing elements (38*a*, 38*b*) are coupled in such a way that, when they are actuated, firstly the first valve closing element (38*a*) always clears an inlet opening (32) to a flow area which has an outlet (34) that communicates with the first flow line (20*a*) and subsequently the second valve closing element (38*b*) clears a further outlet (36) which connects a flow area with the second flow line (20*c*).

2. The device as claimed in claim 1, wherein the valve closing elements (38*a*, 38*b*) are mechanically connected to one another permanently.

3. The device as claimed in claim 1, wherein the valve closing elements (38*a*, 38*b*) are provided on a component (38) which is rotated in a housing (30) and extend in a circumferential direction of the rotatable component (38) in such a way over rotatable circumferential angles that when the rotatable component (38) is rotated in a prescribed direction of rotation the inlet opening (32), which is connected to the operating medium (10), of the housing (30) is firstly cleared in order to open said inlet opening (32) to the flow area which branches off from the housing (30) and is connected to the first flow line (20*a*), and wherein, after a further rotation of the rotatable component (38) in the prescribed direction of travel, the further outlet (36) arranged at the housing (30) is cleared and said further outlet (36) connects said flow area to the second flow line (20*c*).

4. The device as claimed in claim 2, wherein the valve closing elements (38*a*, 38*b*) are provided on a component (38) which is rotated in a housing (30) and extend in a circumferential direction of the rotatable component (38) in such a way over rotatable circumferential angles that when the rotatable component (38) is rotated in a prescribed direction of rotation the inlet opening (32), which is connected to the operating medium (10), of the housing (30) is firstly cleared in order to open said inlet opening (32) to the flow area which branches off from the housing (30) and is connected to the first flow line (20*a*), and wherein, after a further rotation of the rotatable component (38) in the prescribed direction of travel, the further outlet (36) arranged at the housing (30) is cleared and said further outlet (36) connects said flow area to the second flow line (20*c*).

5. The device as claimed in claim 1, wherein the two valve closing elements (38*a*, 38*b*) are arranged on a piston-shaped component (39') which can be axially adjusted in an interior of a housing (30), and are constructed in such a way that in an event of an axial adjustment of the piston-shaped component in a prescribed direction the inlet opening (32), which is connected to the operating medium (10), of the housing (30) is firstly cleared in order to open said inlet opening (32) to the flow area (20*b*) and the outlet (34) which branches off from the housing and is connected to the first flow line (20*a*), and wherein after a further axial adjustment of the piston-shaped component (38') in the prescribed direction, the further outlet (36) arranged at the housing (30) is cleared and said further outlet (36) connects said flow area to the second flow line (20*c*).

6. The device as claimed in claim 2, wherein the two valve closing elements (38*a*, 38*b*) are arranged on a piston-shaped component (39') which can be axially adjusted in an interior of a housing (30), and are constructed in such a way that in an event of an axial adjustment of the piston-shaped component in a prescribed direction the inlet opening (32), which is connected to the operating medium (10), of the housing (30) is firstly cleared in order to open said inlet opening (32) to the flow area (20*b*) and the outlet (34) which branches off from the housing and is connected to the first flow line (20*a*), and wherein after a further axial adjustment of the piston-shaped component (38') in the prescribed direction, the further outlet (36) arranged at the housing (30) is cleared and said further outlet (36) connects said flow area to the second flow line (20*c*).

7. The device as claimed in claim 5, wherein the valve closing element (38*a*, 38*b*) on the piston-shaped component (38') are constructed as areas of different axial heights of a piston wall.

8. The device as claimed in claim 6, wherein the valve closing element (38*a*, 38*b*) on the piston-shaped component (38') are constructed as areas of different axial heights of a piston wall.

9. The device as claimed in claim 1, wherein the two valve closing elements (38*a*, 38*b*) are constructed as disk-shaped valve closing elements, which are arranged axially one behind the other, connected to one another and are adjusted axially by means of activation, in order to open and close the inlet opening and the further outlet, which are concentric to each other, wherein the first valve closing element (38*a*) bears with an end face on a valve seat in a housing surrounding the inlet opening and the second valve closing element (38*b*) is displacable with a circumferential face in a collar which surrounds the further outlet in the housing and is of a prescribed height in the axial direction, and wherein the inlet opening and the outlets are connected to the flow area which is arranged in the interior of the housing.

10. The device as claimed in claim 2, wherein the two valve closing elements (38*a*, 38*b*) are constructed as disk-shaped valve closing elements, which are arranged axially one behind the other, connected to one another and are adjusted axially by means of activation, in order to open and close the inlet opening and the further outlet, which are concentric to each other, wherein the first valve closing element (38*a*) bears with an end face on a valve seat in a housing surrounding the inlet opening and the second valve closing element (38*b*) is displacable with a circumferential face in a collar which surrounds the further outlet in the housing and is of a prescribed height in the axial direction, and wherein the inlet opening and the outlets are connected to the flow area which is arranged in the interior of the housing.

* * * * *